US005836584A

United States Patent [19]

Chen

[11] Patent Number: 5,836,584

[45] Date of Patent: Nov. 17, 1998

[54] SPHERICAL PUZZLE TOY

[76] Inventor: Tsun Ding Chen, P.O. Box 82-144, Taipei, Taiwan

[21] Appl. No.: 889,843

[22] Filed: Jul. 8, 1997

[51] Int. Cl.[6] ..... A63F 9/08

[52] U.S. Cl. ..... 273/153 S

[58] Field of Search ..... 273/153 R, 153 S, 273/155

[56] References Cited

U.S. PATENT DOCUMENTS

| | | | |
|---|---|---|---|
| 4,452,454 | 6/1984 | Greene | 273/153 S |
| 4,553,754 | 11/1985 | Wiggs et al. | 273/153 S |
| 5,389,063 | 2/1995 | Wu | 273/153 S |
| 5,566,941 | 10/1996 | Destics | 273/153 S |

FOREIGN PATENT DOCUMENTS

| | | | |
|---|---|---|---|
| 578621 | 1/1994 | European Pat. Off. | 273/153 S |

*Primary Examiner*—Steven B. Wong
*Attorney, Agent, or Firm*—A & J

[57] ABSTRACT

A spherical puzzle toy includes a spherical shell, which consists of two semi-spherical shells turned on an axis relative to each other, a plurality of partition panels mounted around the spherical shell and defining three intersected tracks around the spherical base along the X,Y and Z axes, and a plurality of slides marked with different marks and moved in the intersected tracks, and wherein the intersected tracks are switched to one another to change the combination of the slides by turning the semi-spherical shells relative to each other.

1 Claim, 4 Drawing Sheets

SPHERICAL PUZZLE TOY

BACKGROUND OF THE INVENTION

1. Field of the Invention

This invention relates to a spherical puzzle toy which comprises a plurality of slides marked with different marks and moved along intersected tracks on two matched semi-spherical shells. When the semi-spherical shells are turned relative to each other, the combination of the slides is changed.

2. Description of the Prior Art

A variety of puzzle toys including triangular puzzle blocks, spuare puzzle blocks, cylindrical puzzleblocks, etc., have been disclosed, and have apperaed on the toy market. These puzzle toys are commonly handy and can be arranged into any of a variety of combinations.

There is also known a spherical puzzle toys comprised of a spherical base having intersected tracks around the periphery, and a plurality of slides moved in the tracks. By moving the slides from one track to another, the slides can be arranged into any of a variety of combinations. This structure of spherical puzzle toy have drawbacks. Because the slides can only be moved one after another, the player cannnot rapidly change the combination of the slides. When the slides have been arranged to a certain combination, a next player can only start from the set combination. Furthermore, this structure of spherical puzzle toy tends to slip in the palm during the play.

SUMMARY OF THE INVENTION

This invention relates to a spherical puzzle toy which comprises a plurality of slides marked with different marks and moved along intersected tracks on two matched semi-spherical shells. When the semi-spherical shells are turned relativve to each other, the combination of the slides is changed.

According to one aspect of the present invention, the spherical puzzle toy comprises a spherical shell, which consists of two semi-spherical plurality of, partition panels mounted around the spherical shell and defining a plurality of intersected tracks, and a plurality of slides marked with different marks and moved in the intersected tracks.

According to another aspect of the present invention, the intersected tracks can be switched to one aonther to change the combination of the slides by turning the semi-spherical shells relative to each other.

According to still another aspect of the present invention, the slides have raised portions at the top, which rub and stimulate the user's palms when the user turns thee semi-spherical shells with the hands.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
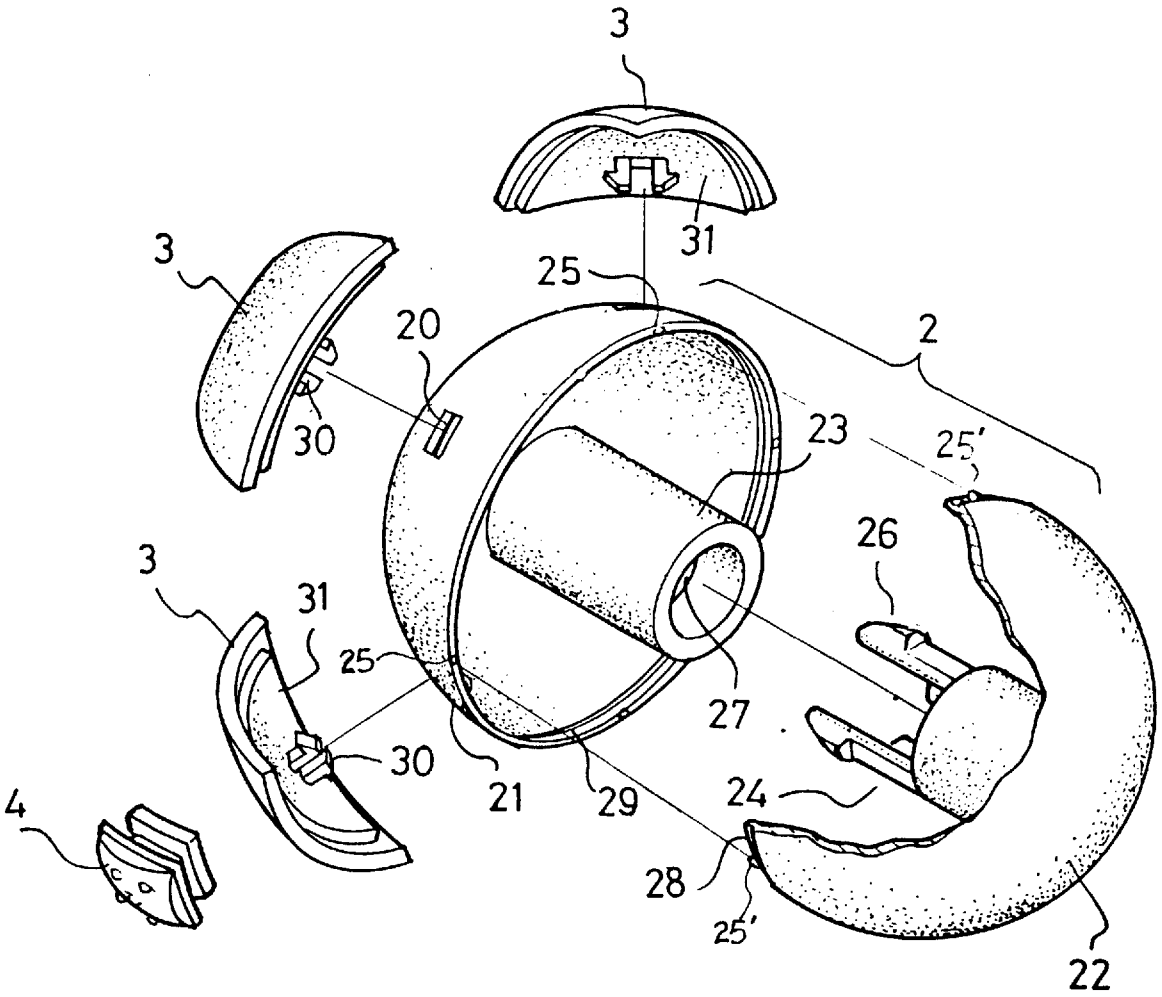
FIG. 1 is an exploded view of a spherical puzzle toy according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIGS. 1, 2, 3 and 4, a spherical puzzle toy 1 in accordance with the present invention is generally comprised of a hollow spherical base 2, a plurality of partition panels 3, and slides 4. The spherical base 2 is comprised of a first semi-spherical shell 21 and a second semi-spherical shell 22. The first and second semi-spherical shells 21 and 22 are joined in such a manner that they can be turned relative to each other. The partition panels 3 are mounted on the outside wall of the spherical base 2, defining intersected tracks for the sliding of the slides 4.

The first semi-spherical shell 21 has a sleeve 23 on the inside at the center. The sleeve 23 has an annular groove 27 around the inside wall, and a plurality of mounting holes 20 through the periphery. The second semi-spherical shell 22 has a split rod 24 on the inside at the center fitted into the sleeve 23. The split rod 24 has an expanded coupling portion 26 at the end engaged into the annular groove 27. When the split rod 24 is compressed radially, the expanded coupling portion 26 can then be inserted into the sleeve 23. After the expanded coupling portion 26 become revolvably retained in the annular groovve 27 inside the sleeve 23. The first semi-spherical shell 21 has an annular groove 28 around the border. The second semi-spherical shell 22 has an annular flange 29 around the border matched with the annular groove 28. Small raised portions 25 and small recessed portions 25' are respectively made on the first and second semi-spherical shells 21 and 22 around the annular flange 29 and the annular groove 28. The raised portions 25 and the recessed portions 25' are alternatively engaged to retain the first and second semi-spherical shells 21 and 22 at a certain angle relative to each other. When the first and second semi-spherical shells 21 and 22 are matched, a line of rotation 200 is defined along the border of the contact area between the first and second semi-spherical shells 21 and 22.

The partition panels 3 are respectively mounted on the periphery of the spherical base 2. Each partition panel 3 has a bottom flange 31 in reduced size, and a hooked coupling portion 30 raised from the bottom flange 31 at the center and hooked in either mounting hole 20 on the spherical base 2. According to the present embodiment, there are total eight partition panels 3 spaced from one another around the spherical base 2 and defining three intersected annular tracks, namely, the X-track 201, the Y-track 202, and the Z-track 203 (see FIGS. 2 and 3).

Figure 2:
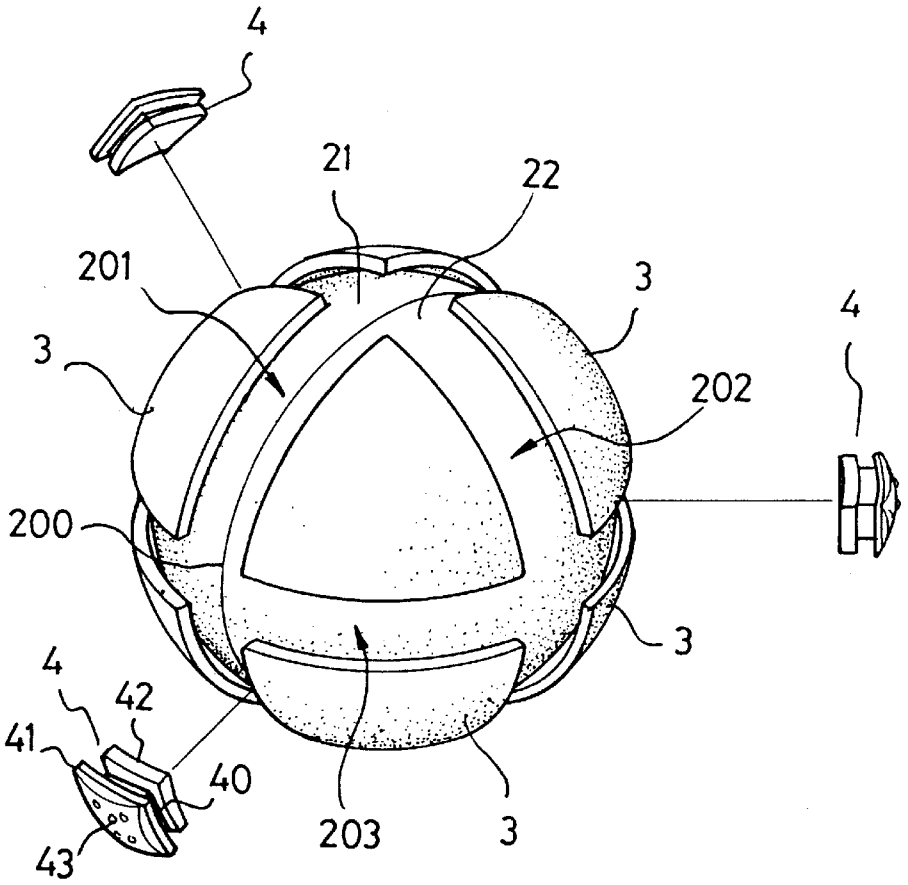
FIG. 2 shows the spherical base and the partition panels of the spherical puzzle toy of the present invention assembled.
Figure 3:
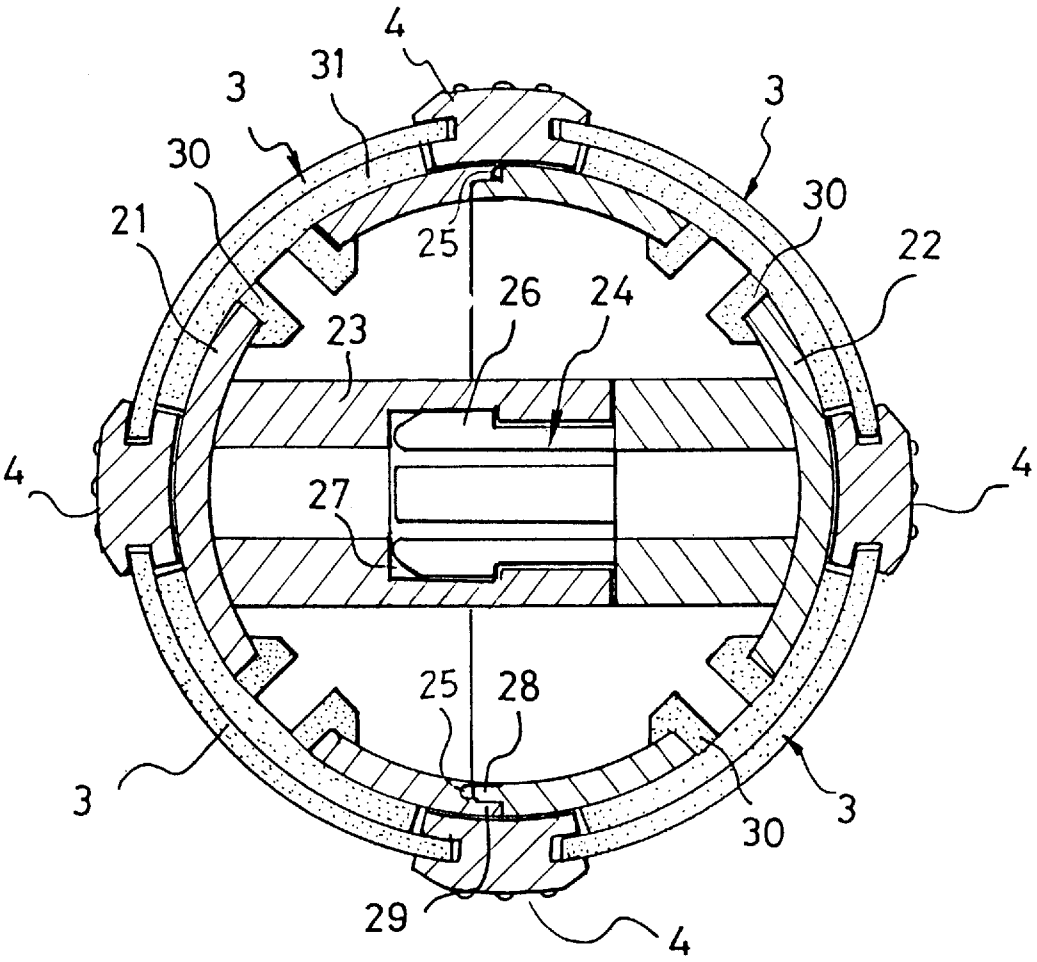
FIG. 3 is a cross section of the spherical puzzle toy of the present invention.
Figure 4:
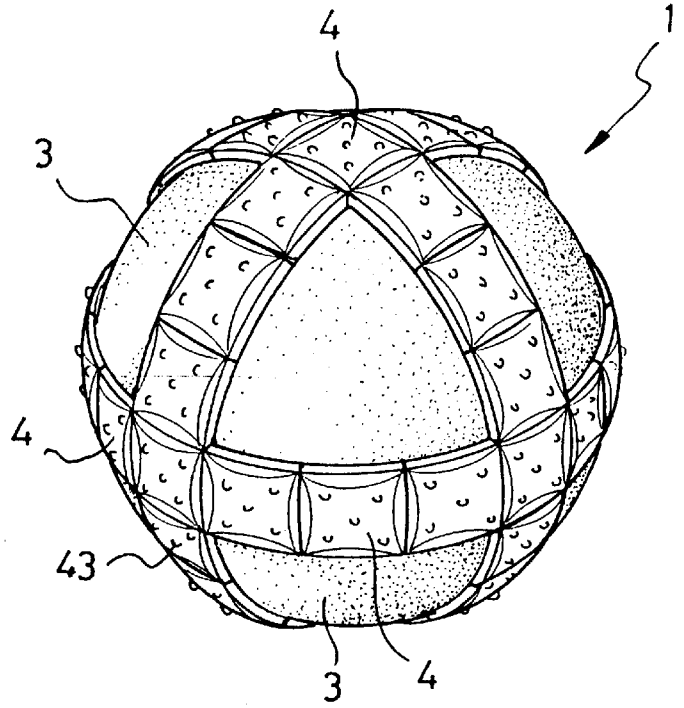
FIG. 4 is an elevational view of the spherical puzzle toy of the present invention.

The slides 4 are made to slide in the tracks 201, 202 and 203. As illustrated in FIGS. 2 and 3, each slide 4 comprises a bottom wall 42 fitting over the periphery of the spherical base 2, a top wall 41 bridging over either two adjacent partition panels 3 and having a plurality of raised portions 43 at the top, and a neck 40 connected between the top wall 41 and the bottom wall 42 and moved along either track 201, 202 or 203. When each slide 4 is moved to any intersected area between either two tracks, the top wall 41 becomes bridging over four adjacent partition panels 3, and therefore it can then be turned at right angle and moved into another track. For example, the slide 4 can be moved from the X-track 201 to the Y-track 202, or from the Z-track 203 to the X-track 201. Because the first semi-spherical shell 21 and the second semi-spherical shell 22 can be turned relative each other along the line of rotation 200, the Y-track 202 and the Z-track 203 can be switched. The raised portions 25 and the recessed portions 25' are arranged to match with the X-track 201 and the Y-track 202, permitting the positions of first and second semi-spherical shells 21 and 22 to be changed relative to each other at 90 degrees per step. Therefore, when the first and second semi-spherical shells 21 and 22 are turned relative to each other through 90 degrees, the slides 4 in the Y-track 202 become aligned with the slides 4 in the Z-track 203.

As indicated, the slides 4 have raised portions 43 on the respective top walls 41. The raised portions 43 rub the muscles of the palm and stimulate the acupuncture points in the palm when the first and second semi-spherical shells 21 and 22 are turned relative to each other. The top walls 41 of the slides 4 may be printed with different colors or marked with different patterns so that the can be arranged into any of a variety of combinations.

The invention is naturally not limited in any sense to the particular features specified in the foregoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A spherical puzzle toy comprising:

a spherical base formed of two semi-spherical shells and having a plurality of mounting holes spaced around the periphery, said semi-spherical shells being turned on an axis relative to each other, said semi-spherical shells including a first semi-spherical shell having a sleeve on the inside at the center, and a second semi-spherical shell having a split rod fitted into said sleeve, said sleeve having an inside annular groove around the inside wall, said split rod having a tapered head revolvably retained in said annular groove, said semi-spherical shells having raised portions and recessed portions alternatively engaged to keep tracks intersected;

a plurality of partition panels having a respective hooked coupling portion respectively hooked in each mounting hole, said partition panels defining a plurality of intersected tracks around the periphery of said spherical base; and a plurality of slides moved in said intersected tracks and having raised portions at the top, which rub the user's palms when the user turns said semi-spherical shells with the hands;

wherein said intersected tracks are switched to one another to change the combination of said slides when said semi-spherical shells are turned relative to each other.

* * * * *